US006631067B2

(12) United States Patent
Newton et al.

(10) Patent No.: US 6,631,067 B2
(45) Date of Patent: Oct. 7, 2003

(54) ELECTROMAGNETIC ACTUATOR FOR ENGINE VALVES

(75) Inventors: Stephen James Newton, Ann Arbor, MI (US); Youqing Xiang, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 129 days.

(21) Appl. No.: 10/034,553

(22) Filed: Dec. 28, 2001

(65) Prior Publication Data

US 2003/0123211 A1 Jul. 3, 2003

(51) Int. Cl.[7] ..... H01H 9/00
(52) U.S. Cl. ..... 361/154; 361/160; 361/190
(58) Field of Search ..... 361/154, 190, 361/191, 155, 159, 160

(56) References Cited

U.S. PATENT DOCUMENTS

| | | | |
|---|---|---|---|
| 4,327,693 | A | 5/1982 | Busser |
| 4,706,619 | A | 11/1987 | Buchl |
| 4,885,658 | A | 12/1989 | Buchl |
| 5,682,127 | A | 10/1997 | Schmitz et al. |
| 5,775,276 | A | 7/1998 | Yanai et al. |
| 6,140,717 | A | 10/2000 | Fischer et al. |
| 6,175,484 | B1 | 1/2001 | Caruthers et al. |

*Primary Examiner*—Anthony Dinkins
(74) *Attorney, Agent, or Firm*—MacMillan, Sobanski & Todd LLC

(57) ABSTRACT

An amplifier/power supply for an engine valve actuator includes a pair of switches for operating an actuator coil in several modes from a low voltage power supply. A higher magnitude voltage is regeneratively created using the inductance of the actuator coil and selective actuation of the switches.

12 Claims, 8 Drawing Sheets

ELECTROMAGNETIC ACTUATOR FOR ENGINE VALVES

FIELD OF THE INVENTION

The present invention relates generally to an electromagnetic actuator and, in particular, to an engine valve control apparatus.

BACKGROUND OF THE INVENTION

One form of known electromechanical actuators includes an armature that moves back and forth along a linear travel path between two electromagnet cores. The armature functions as an actuating member and is operated against the force of two springs positioned on opposite sides of the armature. In an unactuated state, the armature is positioned midway between the two cores by the opposing springs.

Electromagnetic actuators of the above-described type are used, for example, for operating cylinder valves of internal combustion engines. Each cylinder valve is actuated by the armature of the associated electromagnetic actuator. The armature which, by virtue of the forces of the return springs, assumes its position of rest between the two electromagnets, is alternatingly attracted by the one or the other electromagnet, and, accordingly, the cylinder valve is maintained in its closed or open position. If the valve is to be operated, for example, to be moved from the closed position to the open position, the holding current flowing through the electromagnet functioning as the closing magnet is interrupted. As a result, the holding force of the electromagnet falls below the spring force and the armature, accelerated by the spring force, begins to move. After the armature traverses its position of rest, the motion of the armature is braked by the spring force of the oppositely located return spring. To catch and hold the armature in the open position of the cylinder valve, current is applied to the other electromagnet, then functioning as an opening magnet.

To securely catch the armature, because of the inductive behavior of the coils of the electromagnets, either the current supply has to be applied very early to ensure that the current attains the required magnitude in time, or a steep current increase bas to be effected by means of a relatively high magnitude voltage. The latter alternative requires a second supply voltage of higher magnitude than a first supply voltage for holding. The additional structural of a second supply can be saved in principle by applying very early the current to the opening or catching electromagnet. Early application of current, however, is disadvantageous from the point of view of energy economy because the current in such a case builds up over a relatively long period of time during which large losses occur. Further, to maintain defined operational modes, in such an operation the current has to be applied at a time when no current flows through the opposite electromagnet. Such a proceeding is required, for example, if for starting from the position of rest by alternating excitation of the two electromagnets, the oscillation should be approximately at the natural resonance frequency of the spring/mass system.

The U.S. Pat. No. 5,682,127 describes such an actuator and a method of switching supply power to the coils of the electromagnets. The supply voltage is alternately applied to the coils to cause a supply current to flow alternately therethrough to effect a reciprocating motion of the armature. The induced voltage appearing across one of the coils upon removal of the supply voltage is utilized to apply an induced current to the other coil until the supply voltage applied to the other coil is greater than the induced voltage and is capable of maintaining an attained current flow through the other coil.

The U.S. Pat. No. 5,775,276 shows an electromagnetic valve driving apparatus that reduces the electromagnetic force when the valve body is close to the end of the stroke. A flywheel circuit and a variable resistor for increasing the resistance of the flywheel circuit are utilized to decrease the current flowing in the electromagnet coil.

SUMMARY OF THE INVENTION

The present invention concerns an apparatus for operating an electromagnetic actuator coil from a low voltage DC power supply. An amplifier/power supply has an input connected to a low voltage power supply, an output connected to an actuator coil, and a charging path connected between the input and the output and including a selectively switchable switch connected between the output and a circuit ground. Turning on the switch charges an inductance of the actuator coil with current flowing from the power supply along the charging path. The amplifier/power supply also has a discharging path including a capacitor connected between the input and a junction of the output and the switch whereby turning off the switch discharges the inductance of the coil into the capacitor along the discharging path. Alternately switching on and off the switch causes operation in a booster mode.

The amplifier/power supply includes another discharging path having another selectively switchable switch connected in series with the capacitor between the input and the output. After the capacitor is charged to a maximum valve, alternately switching of the switches causes operation in a holding mode. When both of the switches are turned on, the current flowing in the coil increases rapidly and when both of the switches are turned off, the current flowing in the coil decreases rapidly.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The control circuit according to the present invention provides dual voltage operation by regeneratively creating its own high magnitude voltage using the inductance of the actuator coils and the existing amplifier semiconductors. Dual voltage control provides both excellent current transient response and DC current control in the actuator coil. The regenerative feature improves the overall energy efficiency of the system by returning energy to the high voltage and/or low voltage power supplies when the actuator coil current is reduced. The integrated boost feature eliminates the need for a separate, discrete high voltage boost converter.

Figure 1:
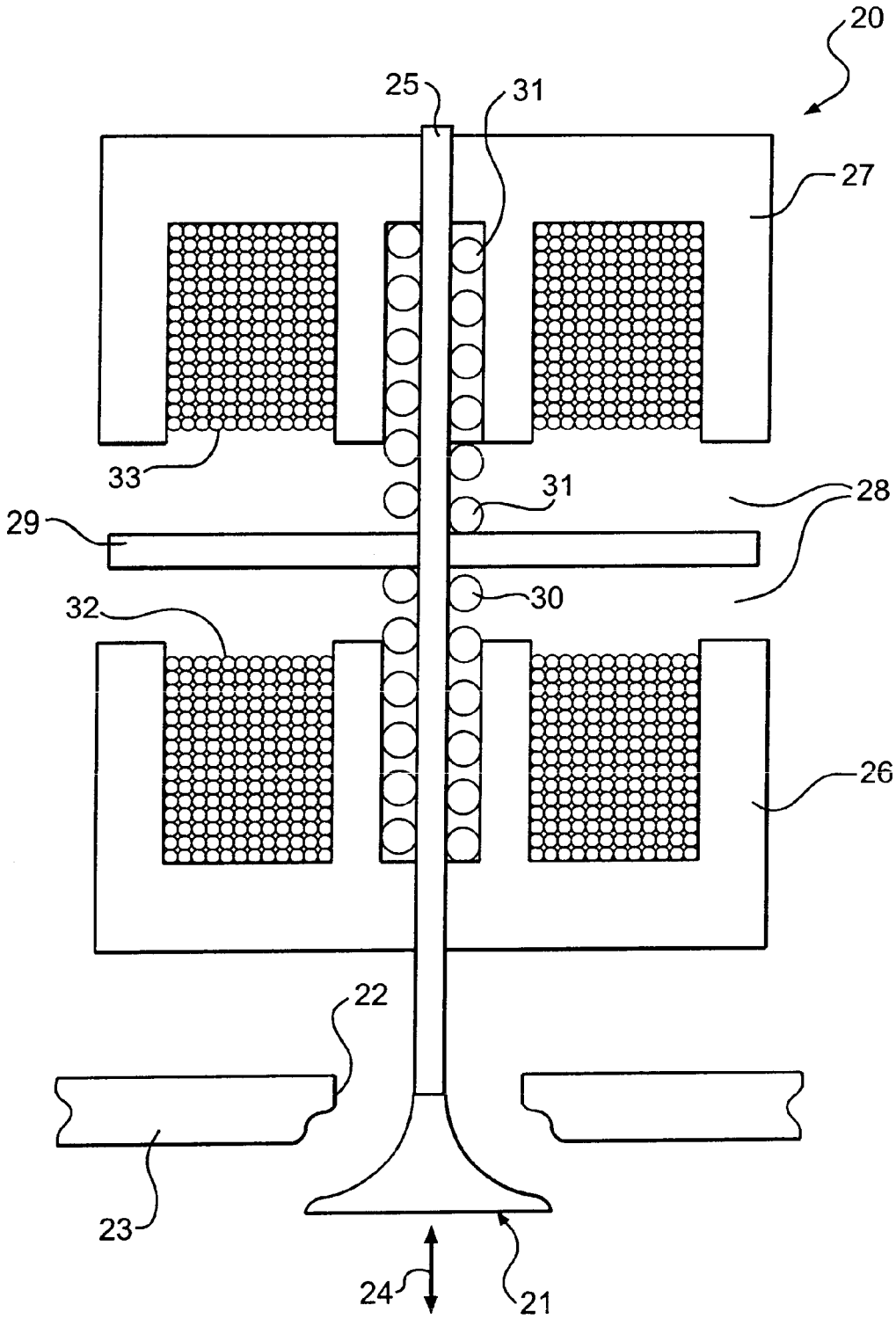
FIG - 1 (PRIOR ART)
FIG. 1 is a schematic view of a prior art electromagnetic valve actuator in an unactuated position.

There is shown in FIG. 1 a known electromagnetically actuated valve assembly 20 including a valve 21 positioned in a port 22 formed in an engine part 23 such as a cylinder head. The valve 21 must be moved back and forth along a linear path indicated by a double-headed arrow 24 to open and close the port 22 thereby controlling the flow of gases either into or out of an associated cylinder (not shown). The valve 21 has a stem 25 that is slidingly retained in a lower core 26 and an upper core 27 wherein a longitudinal axis of the stem 25 is aligned with the path 24. Facing surfaces of the cores 26 and 27 are spaced apart to form a gap 28 in which is positioned an armature 29 attached to the valve stem 25.

In an unactuated state, as shown in FIG. 1, the armature 29 is positioned midway between the facing surfaces of the cores 26 and 27 by a lower spring 30 and an upper spring 31. The lower spring 30 is retained by the lower core 26 and abuts a lower surface of the armature 29. The upper spring 31 is retained by the upper core 27 and abuts an upper surface of the armature 29. The lower core 26 retains a first coil 32 that generates a magnetic field when electrical current flows therethrough attracting the armature 29, against the force of the lower spring 30 and assisted by the force of the upper spring 31, and moving the valve 21 to open the port 22. The upper core 27 retains a second coil 33 that generates a magnetic field when electrical current flows therethrough attracting the armature 29, against the force of the upper spring 31 and assisted by the force of the lower spring 30, and moving the valve 21 to close the port 22.

Figure 2:
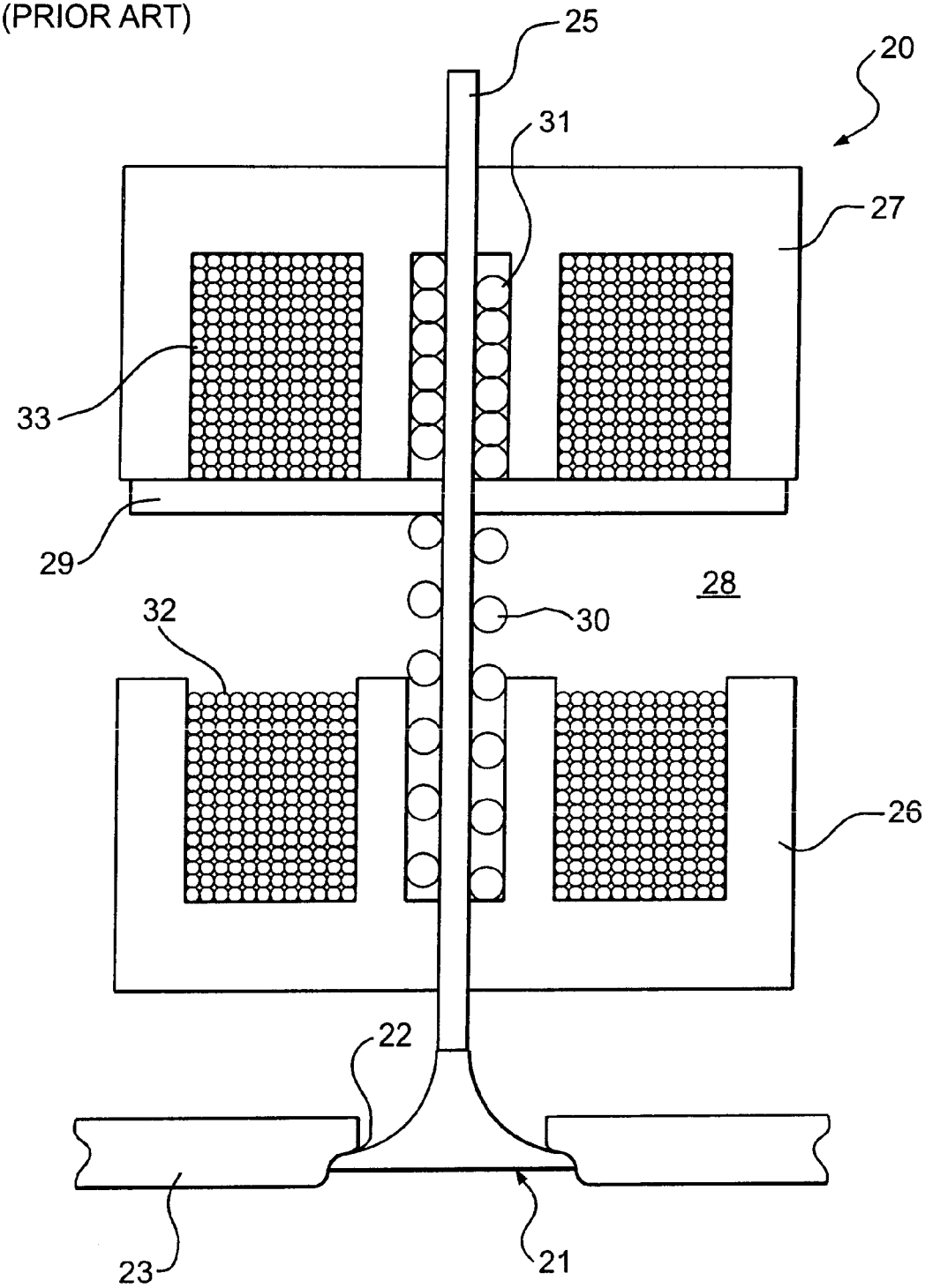
FIG - 2 (PRIOR ART)
FIG. 2 is schematic view of the actuator shown in FIG. 1 in a valve closed position.

The armature 29 can be held against either of the cores 26 and 27 by the application of a holding current to the associated one of the coils 32 and 33. For example, as shown in FIG. 2, application of the holding current to the second coil 33 maintains the armature 29 against the upper core 27 compressing the upper spring 31 and extending the lower spring 30. When it is desired to move the armature 29 from the upper core 27 to the lower core 26, the holding current in the second coil 33 is interrupted. When this occurs, the energy stored in the compressed upper spring 31 and the stretched lower spring 30 accelerates the armature 29 off the upper core 27 toward the lower core 26. In a frictionless system, the armature 29 reaches maximum velocity at the midpoint between the two cores (assuming equal spring forces) and just reaches the lower core 26 with zero velocity, at which time a holding current is established in the first coil 32 to hold the armature 29 against the core 26. However, in physically realizable systems in which friction causes some of the stored energy in the springs 30 and 31 to be lost as heat, the armature 29 will not reach the lower core 26 unless the energy lost to friction is replaced. This is accomplished by creating a "capturing" current in the receiving first coil 32, which current produces a magnetic force of sufficient magnitude to attract the armature 29 and pull it to the lower core 26. Once the armature 29 is "captured" by the receiving first coil 32, the current can be reduced to the holding magnitude sufficient to hold the armature 29 against the core 26 until the next transition is initiated.

Proper control of the speed and position of the armature 29 requires that, at times, the currents in the actuator coils 32 and 33 must be increased and decreased very quickly. Since the rate of change of coil current is proportional to applied coil voltage, high rates of current change require a high magnitude voltage to be applied to the coil. At other times, it is necessary to establish a constant holding current in the coils 32 and 33 of relatively small magnitude. In this case, it is desirable for coil currents to change more slowly when voltage is applied. Again, since the rate of change of coil current is proportional to applied voltage, low rates of current change require that a relatively low magnitude voltage be applied to the coils 32 and 33.

Therefore, the optimum system provides high magnitude voltage for fast current changes and low magnitude voltage for constant current requirements. In the case of an electromechanical valve actuation system that is used to control the valves in an automobile internal combustion engine, the low voltage power supply can be the automobile 12 volt (or other standard voltage) system. However, the high magnitude voltage (normally a few hundred volts) must be created from the low voltage system. A discrete high voltage power supply, that operates from the low voltage system, can be used to create the required high voltage. However, this supply will be a relatively large, heavy and expensive component.

Figure 3:
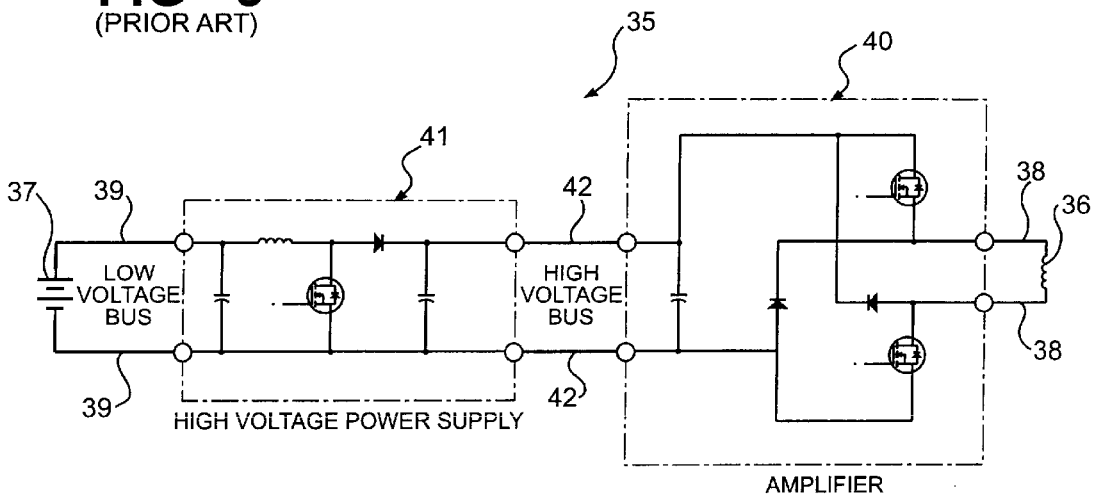
FIG - 3 (PRIOR ART)
FIG. 3 is a schematic diagram of a prior art control circuit for the actuator shown in FIGS. 1 and 2.

FIG. 3 shows a prior art single rail electromechanical valve actuation system 35 having a valve actuator coil 36 powered from a DC power supply 37. The coil 36 is connected across a pair of output lines 38 and the power supply 37 is connected to a low voltage bus. 39. The output lines 38 are connected to a pair of output terminals of an amplifier 40 and the bus 39 is connected to a pair of input terminals of a high voltage power supply 41. A high voltage bus 42 connects a pair of output terminals of the power supply 41 to a pair of input terminals of the amplifier 40. Because the amplifier 40 is limited to operation from a single voltage, this voltage must be high enough in magnitude to produce fast current changes in the actuator coil 36 when required, but low enough to provide stable, low current DC control. With only a single voltage available, neither of these functions can be optimized. Also, the discrete high voltage power supply 41 contains some large, expensive components that must be packaged, connected and heat sunk.

Figure 4:
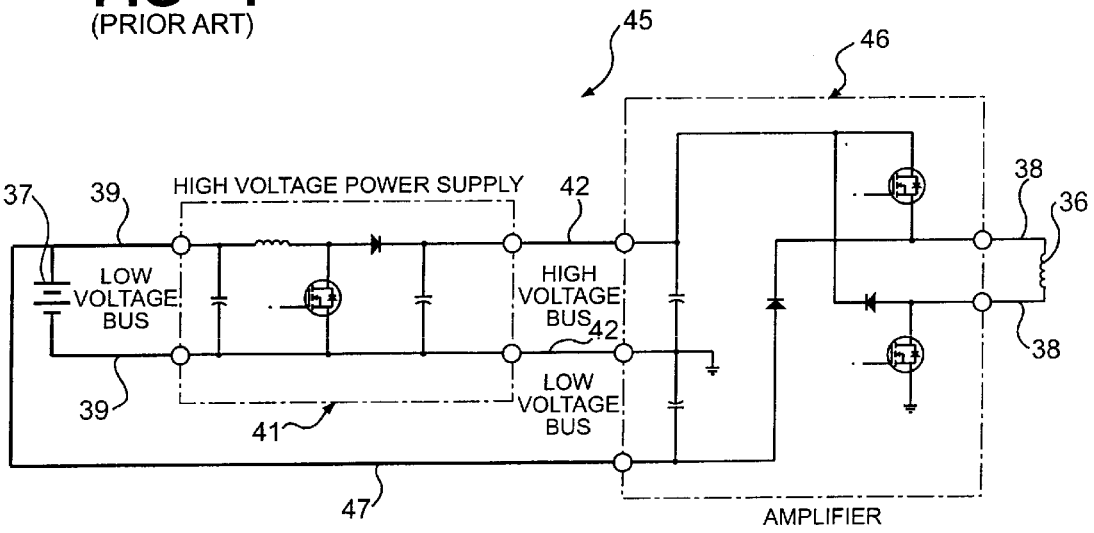
FIG - 4 (PRIOR ART)
FIG. 4 is a schematic diagram of another prior art control circuit for the actuator shown in FIGS. 1 and 2.

In FIG. 4, there is shown a prior art dual rail electromechanical valve actuation system 45 having the valve actuator coil 36 powered from the DC power supply 37. The high voltage bus 42 is connected to a pair of inputs of an amplifier 46, similar to the amplifier 40, to feed a high magnitude voltage to allow fast current changes in the actuator coil 36. A low voltage rail 47, for slow current changes and constant coil current conditions, is connected between a positive potential terminal of the power supply 37 an a third input terminal of the amplifier 46. Again, the discrete high voltage power supply 41 is required to provide the high magnitude voltage to the amplifier 46.

Figure 5:
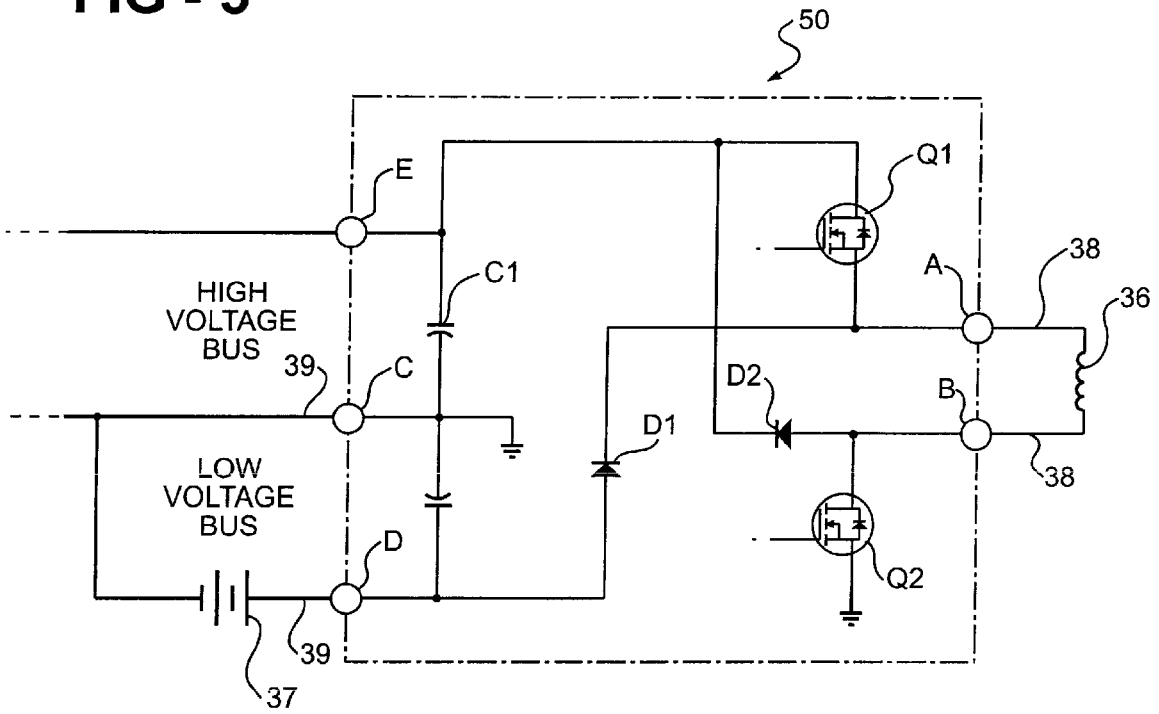
FIG. 5 is a schematic diagram of a control circuit according to the present invention for the actuator shown in FIGS. 1 and 2.

The actuation system according to the present invention includes a power amplifier topology that provides dual voltage operation without the need for a discrete high voltage power supply by regeneratively creating its own high voltage using the inductance of the actuator coils and the existing semiconductor devices in the amplifier. There is shown in FIG. 5 an integrated power amplifier/high voltage power supply 50 that not only creates its own high magnitude voltage, but also provides for dual voltage operation. There are four modes of operation for the amplifier/power supply 50: (1) Boost Mode; (2) Holding Mode; (3) Rapid Current Increase Mode; and (4) Rapid Current Decrease Mode. Each mode of operation is described in more detail below.

The actuator coil 36 is connected to a pair of output terminals "A" and "B" of the amplifier/power supply 50 by the output lines 38 while the power supply 37 is connected to a pair of input terminals "C" and "D" by the low voltage bus 39. A capacitor C1 and a first MOSFET switch Q1 are connected in series between the negative polarity side of the low voltage bus 39 (terminal "C") and the one of the output lines 38 connected to the terminal "A". A first diode D1 is connected between the positive polarity side of the low voltage bus 39 (terminal "D") and the one output line 38 connected to the terminal "A". A second MOSFET switch Q2 is connected between the other output line 38 (terminal "B") and ground potential and a second diode D2 is connected between the other output line 38 (terminal "A") and the junction of the capacitor C1 and the switch Q1.

Figure 6:
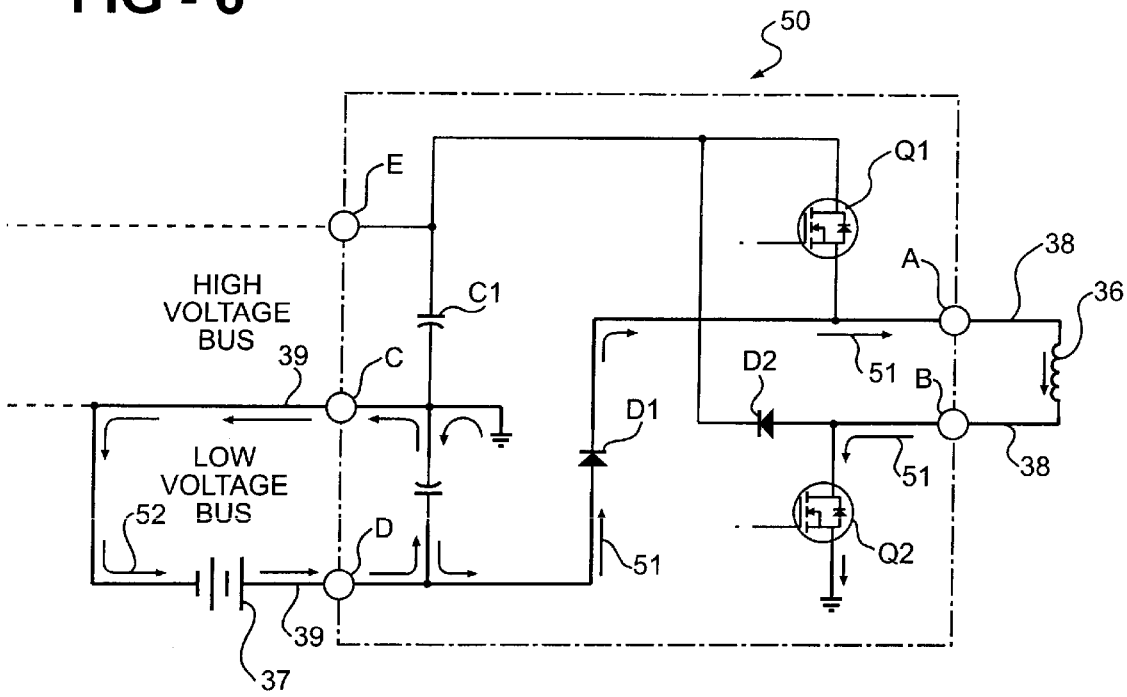
FIG. 6 is a schematic diagram of the control circuit shown in FIG. 5 operating in a coil charging boost mode.
Figure 7:
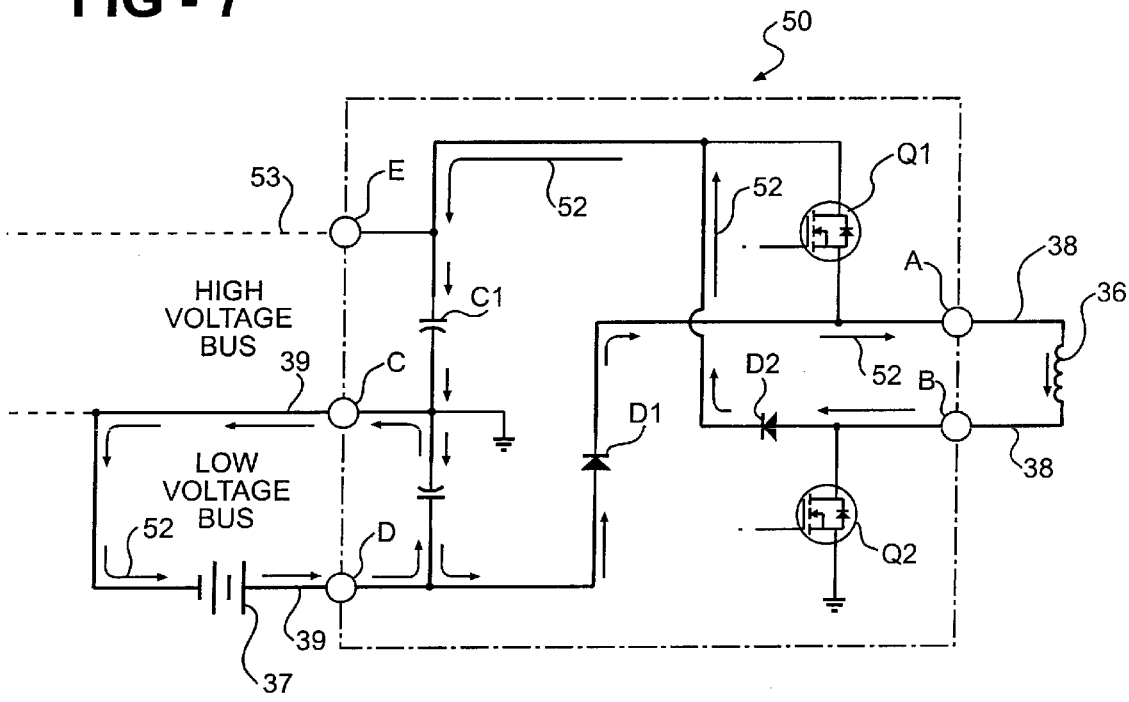
FIG. 7 is a schematic diagram of the control circuit shown in FIG. 5 operating in a coil discharging boost mode.
Figure 8:
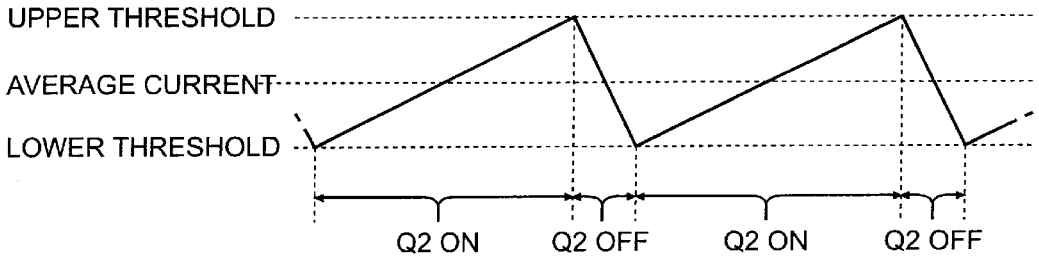
FIG. 8 is a waveform diagram of the coil current when the control circuit is operating in the boost mode shown in FIGS. 5 and 6.

Operation in the Boost Mode is shown in FIGS. 6–8. In FIG. 6, the first switch Q1 is turned OFF and the second switch Q2 is turned ON to charge the coil inductance from the low voltage supply 37 and the low voltage bus 39. Current flow is shown by arrows 51. During this charging time, the coil current increases. When the switch Q2 is turned OFF (FIG. 7), the coil 36 discharges and the coil current (current flow is shown by arrows 52) freewheels into a high voltage bus 53 connected to a terminal "E". The current charges the first capacitor C1 connected across the terminals "C" and "E" of the amplifier/power supply 50.

The coil current is allowed to ripple around an average value (FIG. 8) while charging the high voltage bus capacitor C1.

Figure 9:
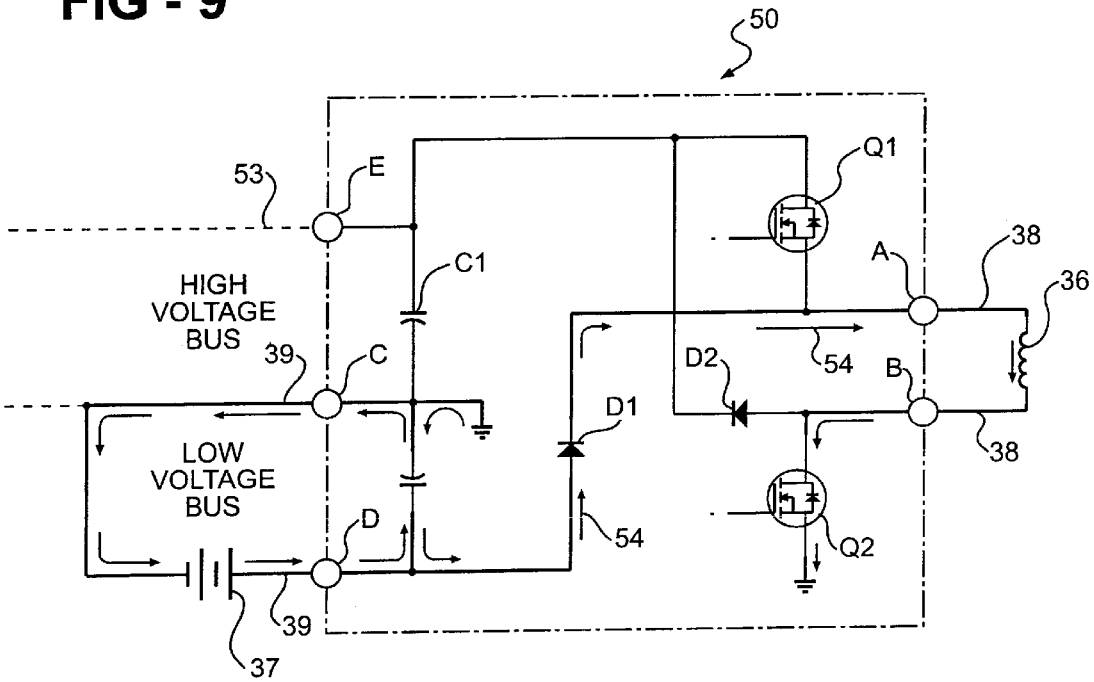
FIG. 9 is a schematic diagram of the control circuit shown in FIG. 5 operating in a coil charging holding mode.
Figure 10:
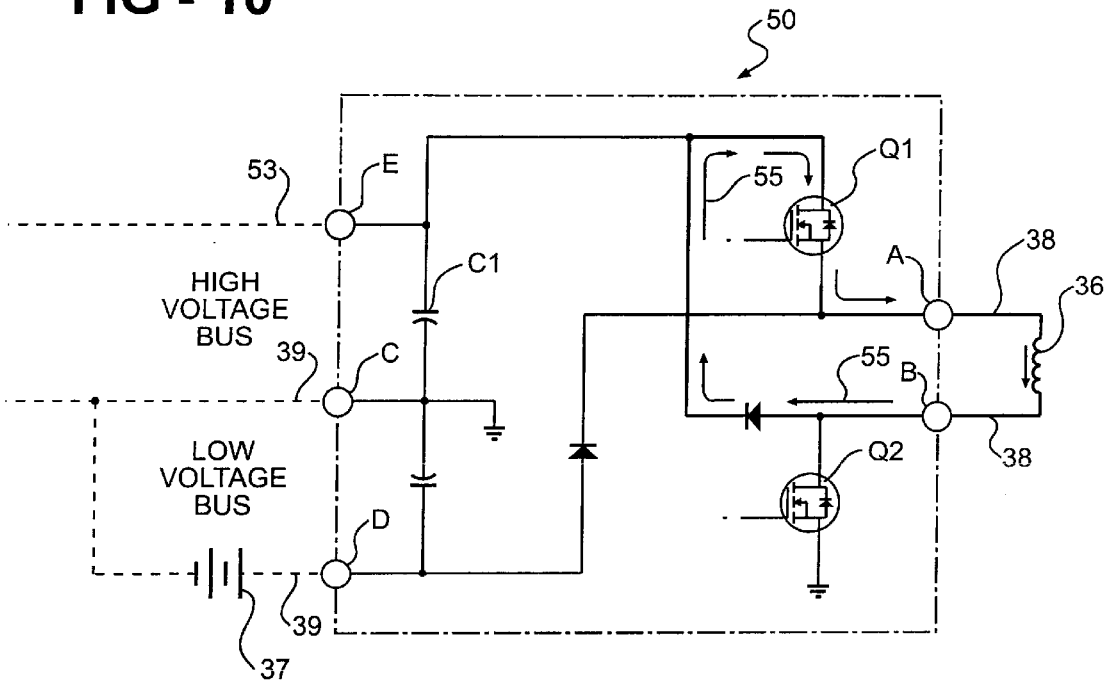
FIG. 10 is a schematic diagram of the control circuit shown in FIG. 5 operating in a coil discharging holding mode.
Figure 11:
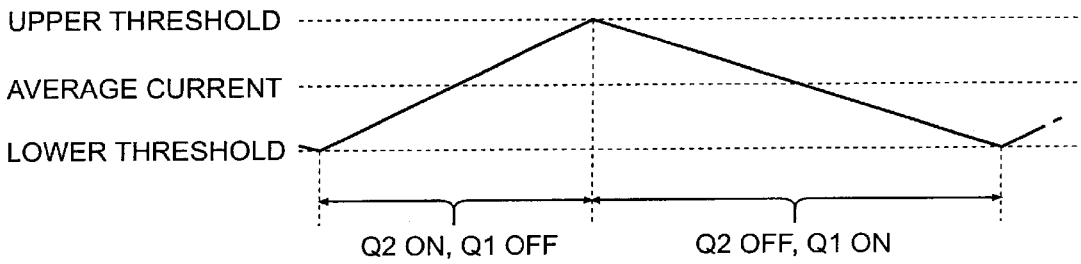
FIG. 11 is a waveform diagram of the coil current when the control circuit is operating in the holding mode shown in FIGS. 9 and 10.

The Holding Mode, as shown in FIGS. 9–11, provides low voltage current regulation. Once the high voltage bus 53 is fully charged by the capacitor C1, the coil current is maintained by charging from the low voltage bus 39 (Q1 OFF, Q2 ON), and freewheeling into and out of the high voltage bus (Q1 ON, Q2 OFF). In this mode, energy dissipated in the coil resistance is replenished from the low voltage supply 37. FIG. 9 shows the current path (arrows 54) during coil charging and FIG. 10 shows the current path (arrows 55) during coil discharging. FIG. 11 shows the Holding Mode current waveforms.

Figure 12:
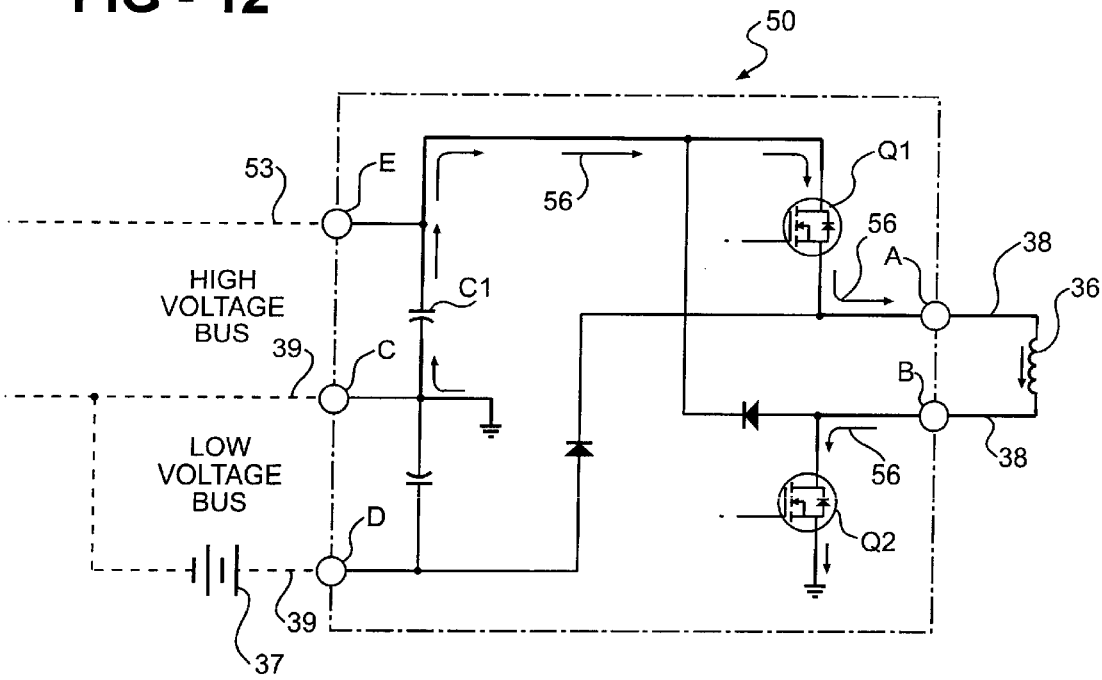
FIG. 12 is a schematic diagram of the control circuit shown in FIG. 5 operating in a rapid coil current increase mode.

The Rapid Current Increase Mode of operation is shown in FIG. 12. The coil current is increased rapidly by turning ON both Q1 and Q2 and charging the coil inductance from the high voltage bus 53 (capacitor C1). The current path is shown by arrows 56.

Figure 13:
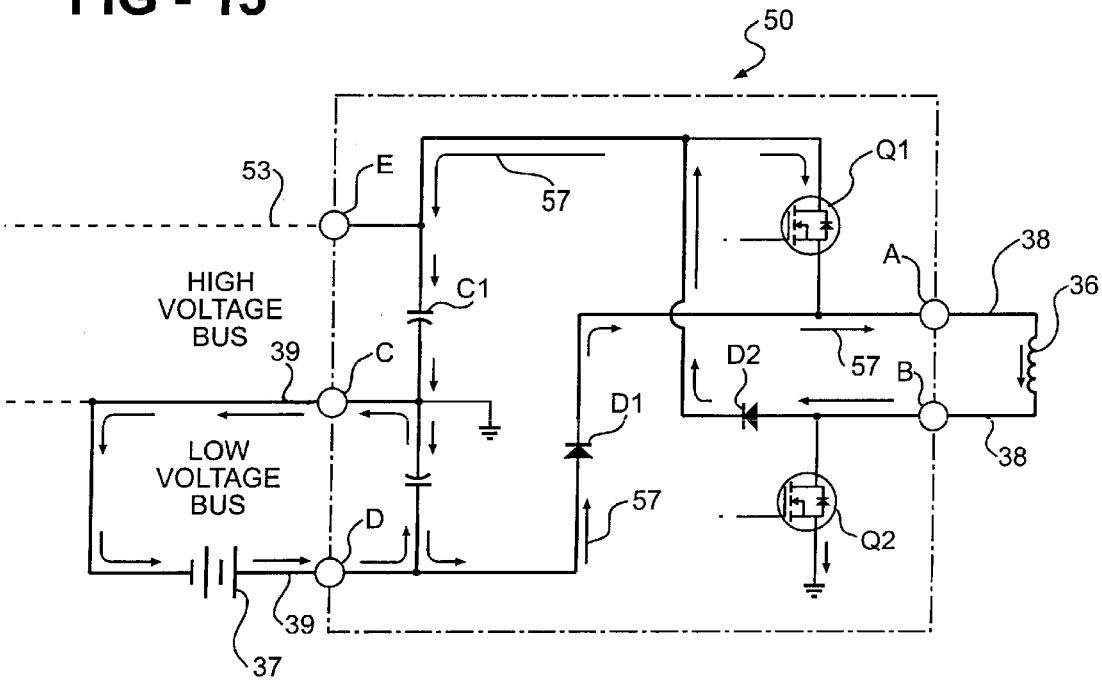
FIG. 13 is a schematic diagram of the control circuit shown in FIG. 5 operating in a rapid coil current decrease mode.

The Rapid Current Decrease Mode of operation is shown in FIG. 13. The coil current is decreased rapidly by turning OFF both Q1 and Q2 and allowing the coil current (arrows 57) to freewheel into the high voltage bus 53 and out of the low voltage bus 39 via the diodes D1 and D2. The high voltage bus 53 is always charged during the Rapid Current Decrease Mode at the capacitor C1.

A separate one of the amplifier/power supply 50 would be connected to each of the coils 32 and 33 of the electromagnetically actuated valve assembly 20 shown in FIGS. 1 and 2. The switching signals required to turn ON and OFF the switches Q1 and Q2 can be generated by conventional circuitry.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for controlling an electromagnetic actuator having a coil comprising:

an input adapted to be connected to a low voltage power supply;

an output adapted to be connected to an actuator coil;

a charging path connected between said input and said output and including a selectively switchable switch connected between said output and a circuit ground whereby when said input is connected to a low voltage power supply and said output is connected to the actuator coil, turning on said switch charges an inductance of the coil with current flowing from the power supply along said charging path; and a discharging path including a capacitor connected between said input and a junction of said output and said switch whereby turning off said switch discharges the inductance of the coil into said capacitor along said discharging path.

2. The apparatus according to claim 1 wherein said discharging path includes a portion of said charging path.

3. The apparatus according to claim 1 wherein said discharging path includes a diode.

4. The apparatus according to claim 1 wherein alternately switching said switch on for a first predetermined time period and off for a second predetermined time period causes operation in a boost mode whereby a magnitude of the current flowing along said second current flow path and through the coil alternately increases to an upper threshold value and decreases to a lower threshold value providing a predetermined average coil current value.

5. The apparatus according to claim 1 including another switch connected in series with said capacitor between said input and said output wherein when said capacitor is charged to a predetermined full charge value, alternately switching on said switches causes operation in a holding mode whereby a magnitude of the current flowing through the coil alternately increases to an upper threshold value and decreases to a lower threshold value providing a predetermined average coil current value.

6. The apparatus according to claim 5 wherein a magnitude of the current flowing through the coil rapidly increases when both of said switches are turned on.

7. The apparatus according to claim 5 wherein a magnitude of the current flowing through the coil rapidly decreases when both of said switches are turned off.

8. The apparatus according to claim 5 wherein said switches are MOSFET switches.

9. The apparatus according to claim 1 including a diode connected in said charging path.

10. An apparatus for controlling an electromagnetic actuator having a coil comprising:

a pair of low voltage input terminals adapted to be connected to a DC low voltage power supply;

a pair of output terminals adapted to be connected to an actuator coil;

a selectively switchable first switch and a capacitor connected in series between one of said input terminals and one of said output terminals;

a first diode connected between another one of said input terminals and said one output terminal;

a selectively switchable second switch connected between said another one of said output terminals and a circuit ground; and second diode connected said another one of said output terminals and a junction of said capacitor and said first switch.

11. An electromagnetic actuator assembly comprising:

a low voltage input adapted to be connected to a DC low voltage power supply;

an output;

an actuator coil connected to said output;

a charging path connected between said input and said output and including a selectively switchable switch connected between said output and a circuit ground whereby when said input is connected to a low voltage power supply, turning on said switch charges an inductance of said coil with current flowing from the power supply along said charging path; and a discharging path including a capacitor connected between said input and a junction of said output and said switch whereby turning off said switch discharges the inductance of said coil into said capacitor along said discharging path.

12. The apparatus according to claim 11 including another discharging path having another selectively switchable switch connected in series with said capacitor between said input and said output whereby when said switches are turned on, the current flowing in said coil increases rapidly.

* * * * *